US008172609B2

(12) United States Patent
Hsia

(10) Patent No.: US 8,172,609 B2
(45) Date of Patent: May 8, 2012

(54) JOINT FOR A CABLE

(76) Inventor: Yvonne C. Hsia, Taichung (TW)

( * ) Notice: Subject to any disclaimer, the term of this patent is extended or adjusted under 35 U.S.C. 154(b) by 134 days.

(21) Appl. No.: 12/849,832

(22) Filed: Aug. 4, 2010

(65) Prior Publication Data

US 2012/0032433 A1 Feb. 9, 2012

(51) Int. Cl.
*H01R 9/05* (2006.01)

(52) U.S. Cl. ..... 439/578

(58) Field of Classification Search ..... 439/578, 439/583–585, 320, 271–275
See application file for complete search history.

(56) References Cited

U.S. PATENT DOCUMENTS 7,479,035 B2 * 1/2009 Bence et al. ..... 439/583
7,727,011 B2 * 6/2010 Montena et al. ..... 439/578
7,850,487 B1 * 12/2010 Wei ..... 439/578
2007/0049113 A1 * 3/2007 Rodrigues et al. ..... 439/578
2010/0136827 A1 * 6/2010 Chawgo ..... 439/578
2011/0065317 A1 * 3/2011 Shaw et al. ..... 439/578
2011/0117777 A1 * 5/2011 Thomas et al. ..... 439/578
2011/0230090 A1 * 9/2011 Bence et al. ..... 439/578

* cited by examiner

*Primary Examiner* — Jean F Duverne

(57) ABSTRACT

A joint for a cable contains a connecting sleeve including threads around an inner wall of an upper end thereof and a shoulder on a bottom end of an inner wall thereof; an internal tube including an arresting ring extending around an upper end thereof and a circular groove around an outer wall thereof; an inner fitting member including a hole disposed on a top surface thereof, at least one curved recess formed on an outer wall thereof, and the inner fitting member including an insertion extending from a bottom end thereof; an outer fitting member including a protrusion and a first fixing section disposed on a bottom end thereof; a sheath member including a bore mounted on an upper end thereof, the bore including an annular cutout formed on an outer wall thereof and a raised loop fixed on a bottom end thereof; a banding member fitted to the annular cutout.

10 Claims, 7 Drawing Sheets

JOINT FOR A CABLE

BACKGROUND OF THE INVENTION

1. Field of the Invention

The present invention relates to a joint for a cable that is assembled easily and conveniently.

2. Description of the Prior Art

Cable is used to transmit image or electronic signal/data, and includes a joint disposed on a connecting end thereof to be fixed to an entry of an electronic device.

Conventional joint for the cable is comprised of a plurality of separated connecting components, and the connecting components are made of metal material. Therefore, the components of the joint can not be assembled easily because of high metal hardness, and they have to be assembled together by using an auxiliary tool. Besides, the components are made of metal material to enhance production cost.

The present invention has arisen to mitigate and/or obviate the afore-described disadvantages.

SUMMARY OF THE INVENTION

The primary object of the present invention is to provide a joint for a cable that is assembled easily and conveniently without using an auxiliary tool.

Another object of the present invention is to provide a joint for a cable that is made of plastic material to lower production cost and time.

To obtain the above objectives, a joint for a cable provided by the present invention comprises a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape to insert into a core segment of the cable, and including an arresting ring extending outward around an upper end thereof to abut against the shoulder of the connecting sleeve, and including a circular groove arranged around an outer wall thereof;

an inner fitting member being a hollow housing, and including an orifice formed on a bottom end of a fourth opening thereof, and including a hole disposed on a top surface thereof, the hole including a circular projection formed around an inner surface thereof to correspond to the circular groove of the internal tube such that the inner fitting member is fitted to the outer wall of the internal tube by using the hole and further enable to rotate the connecting sleeve, the inner fitting member also including at least one curved recess formed on an outer wall of a lower side thereof, the recess becoming concaved upward from the bottom end of the inner fitting member and after bending toward one side of the inner fitting member and extending upward, the inner fitting member further including an insertion extending from the bottom end thereof;

an outer fitting member being a hollow housing and including two ends, each having a second opening, to be fitted to the inner fitting member, the outer fitting member also including a protrusion extending proximate to an inner rim of the second opening of a top end thereof to correspond to the recess of the inner fitting member, and including a first fixing section disposed on a bottom end thereof;

a sheath member being flexible and formed in a tube shape, and including two ends, each with a third opening, and including a bore mounted on an upper end thereof, when the bore is not forced, its outer diameter being slightly smaller than the insertion of the inner fitting member, and the bore including an annular cutout formed on an outer wall thereof and a raised loop fixed on a bottom end thereof, an outer diameter of the raised loop being in response to an inner wall of the outer fitting member, and the raised loop including a second fixing section secured on an outer wall thereof to correspond to the first fixing section of the outer fitting member;

a banding member fitted to the annular cutout of the sheath member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
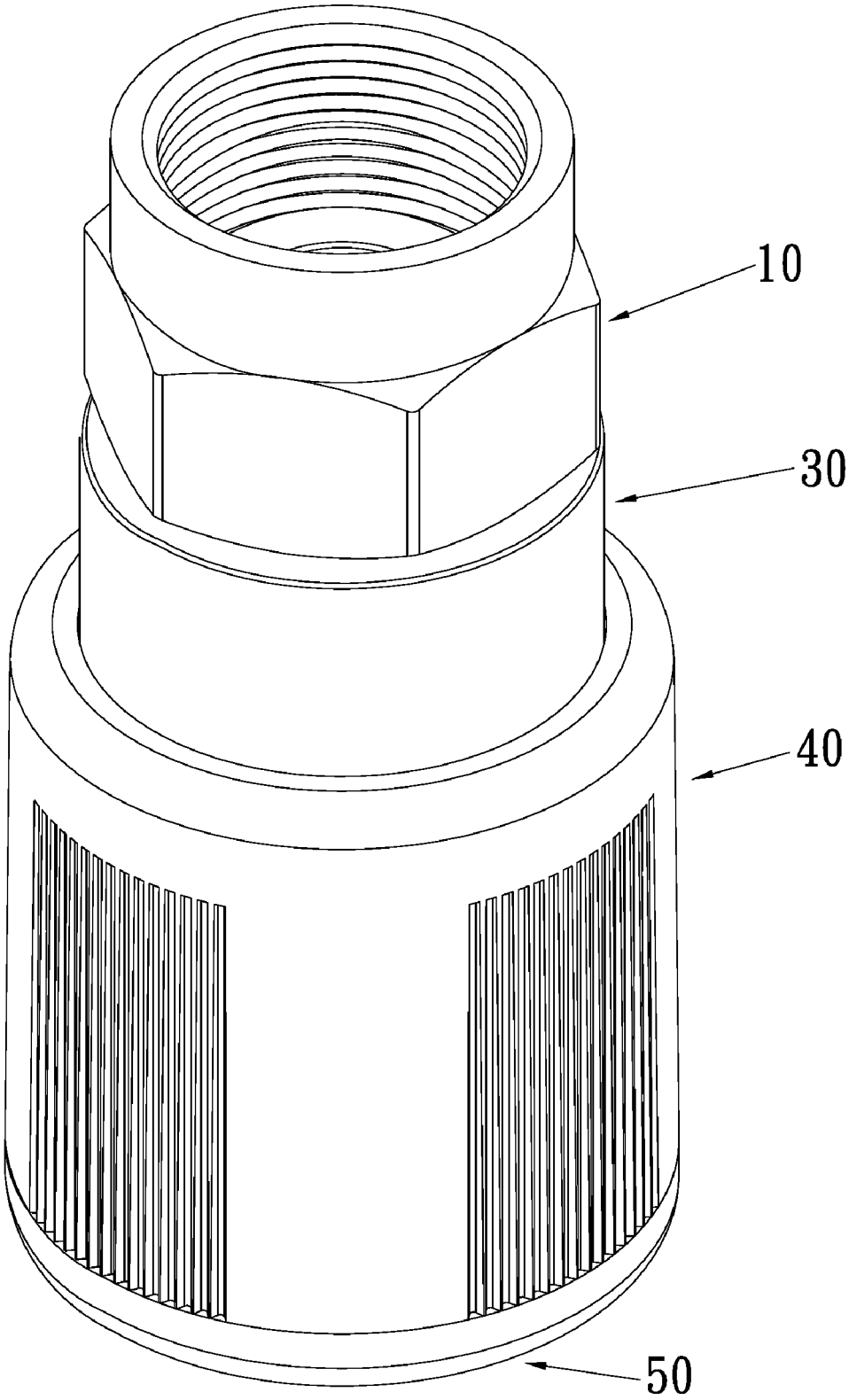
FIG. 1 is a perspective view showing the assembly of a joint for a cable according to a preferred embodiment of the present invention.
Figure 2:
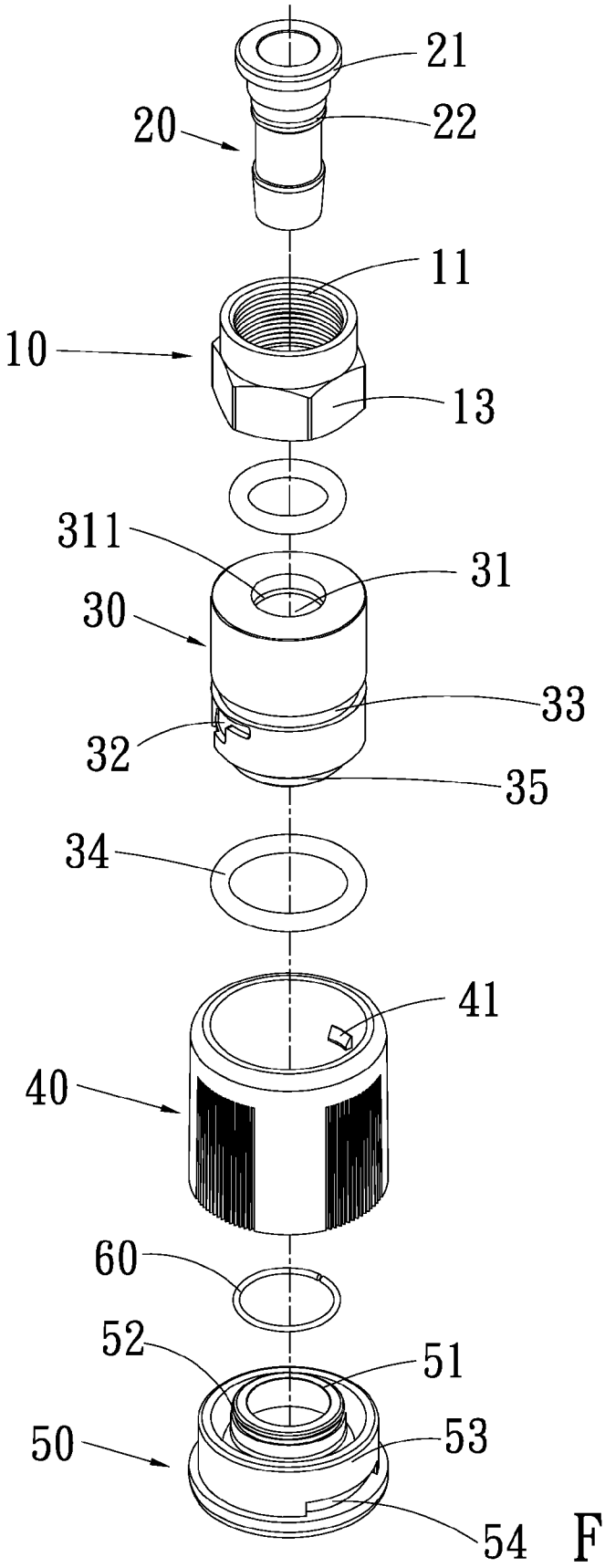
FIG. 2 is a perspective view showing the exploded components of the joint for the cable according to the preferred embodiment of the present invention.
Figure 3:
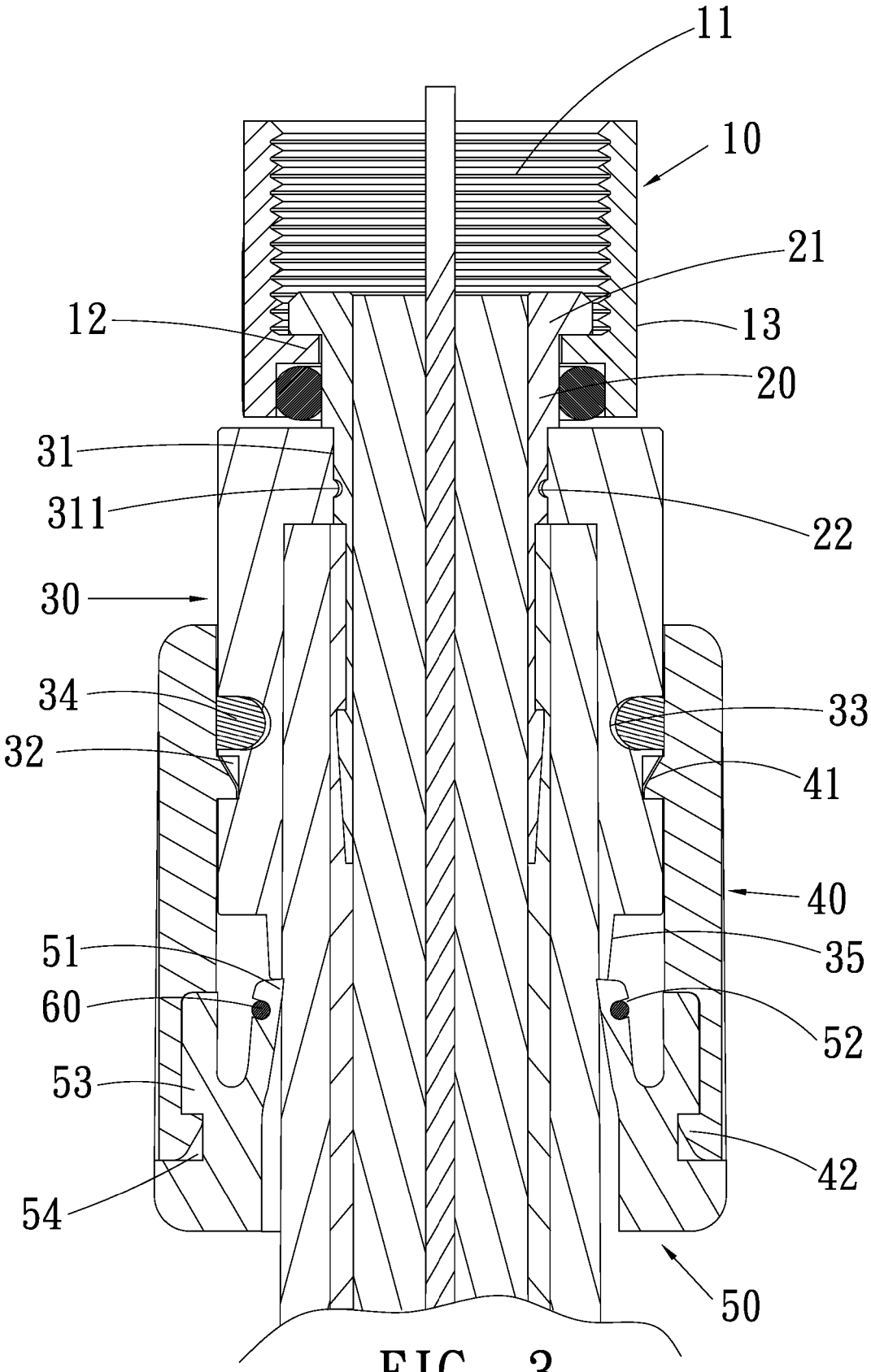
FIG. 3 is a cross sectional view showing of the assembly of the joint for the cable according to the preferred embodiment of the present invention.
Figure 4:
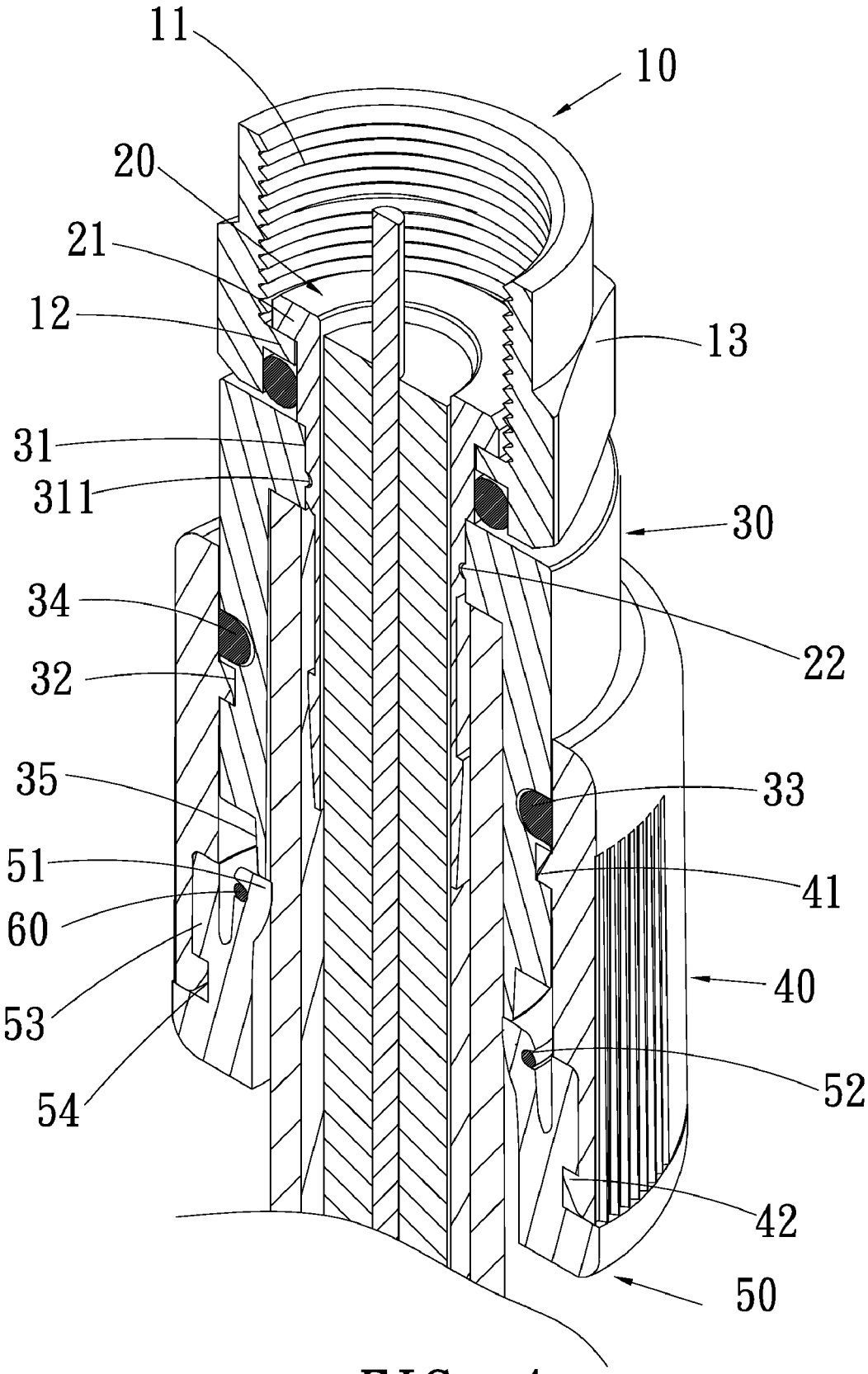
FIG. 4 is a perspective view showing the cross section of the joint for the cable according to the preferred embodiment of the present invention.
Figure 5:
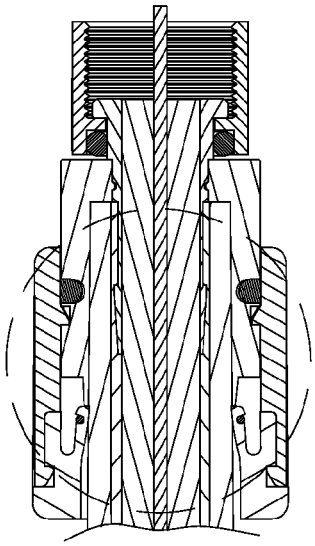
FIG. 5 is a cross sectional view showing a part of the joint for the cable according to the preferred embodiment of the present invention.
Figure 5A:
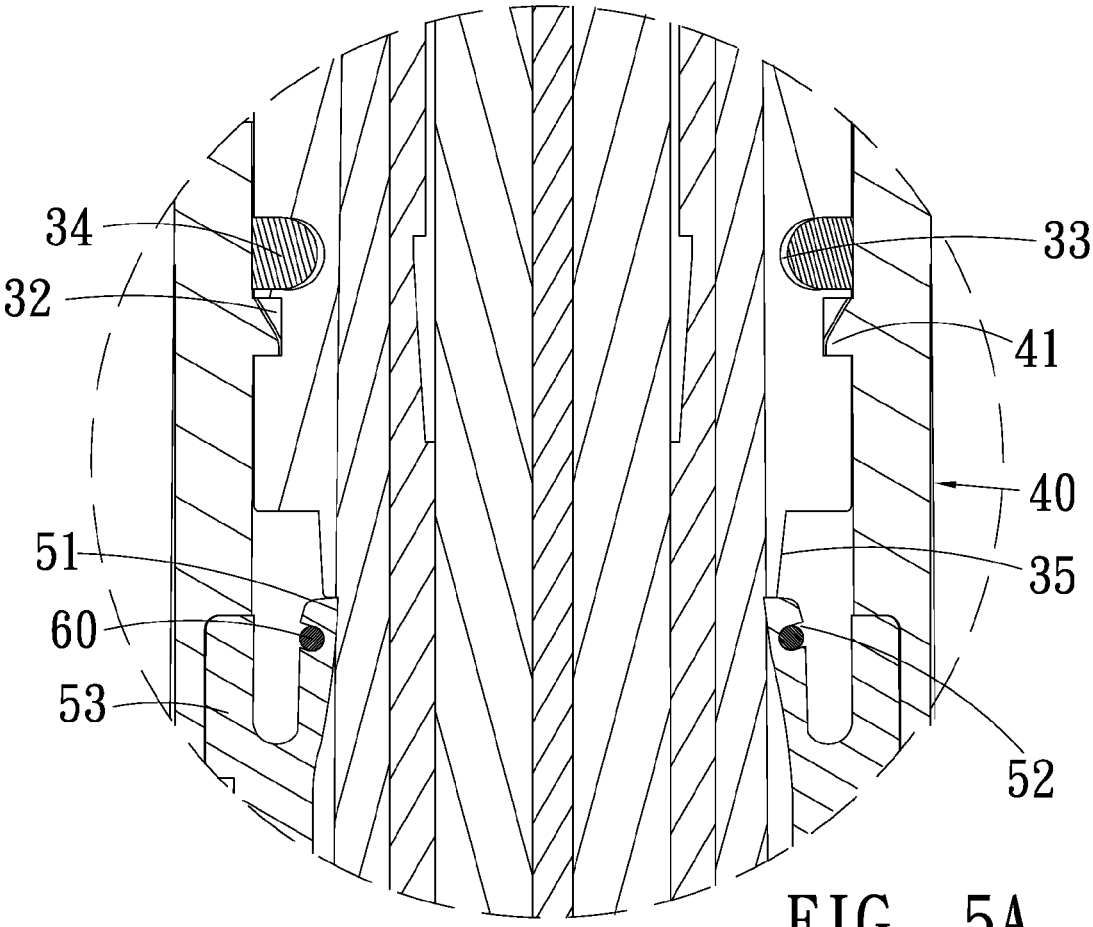
FIG. 5A is an amplified cross sectional view showing a part of the joint for the cable according to the preferred embodiment of the present invention.
Figure 6:
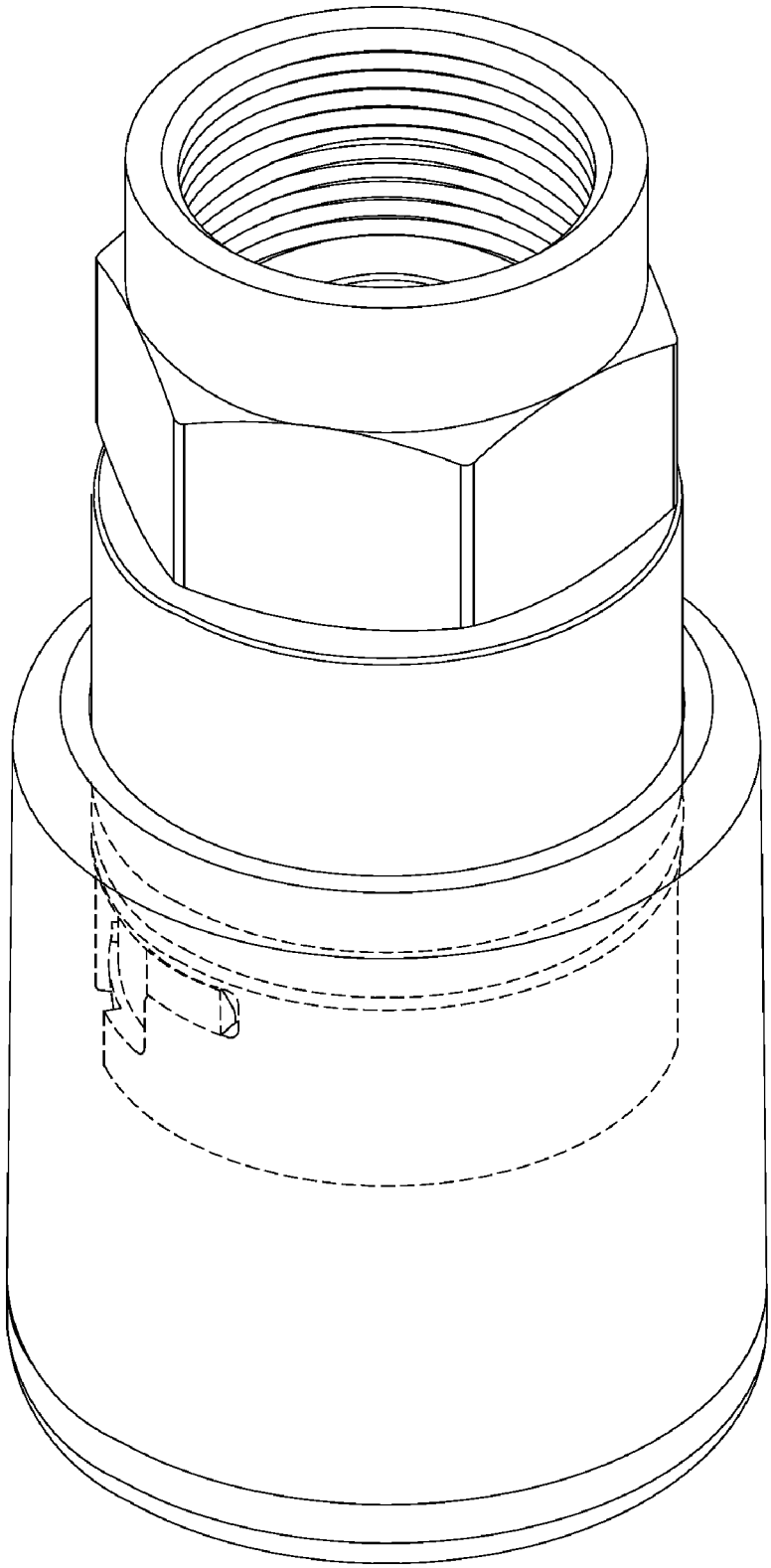
FIG. 6 is a perspective view showing the operation of the joint for the cable according to the preferred embodiment of the present invention.
Figure 7:
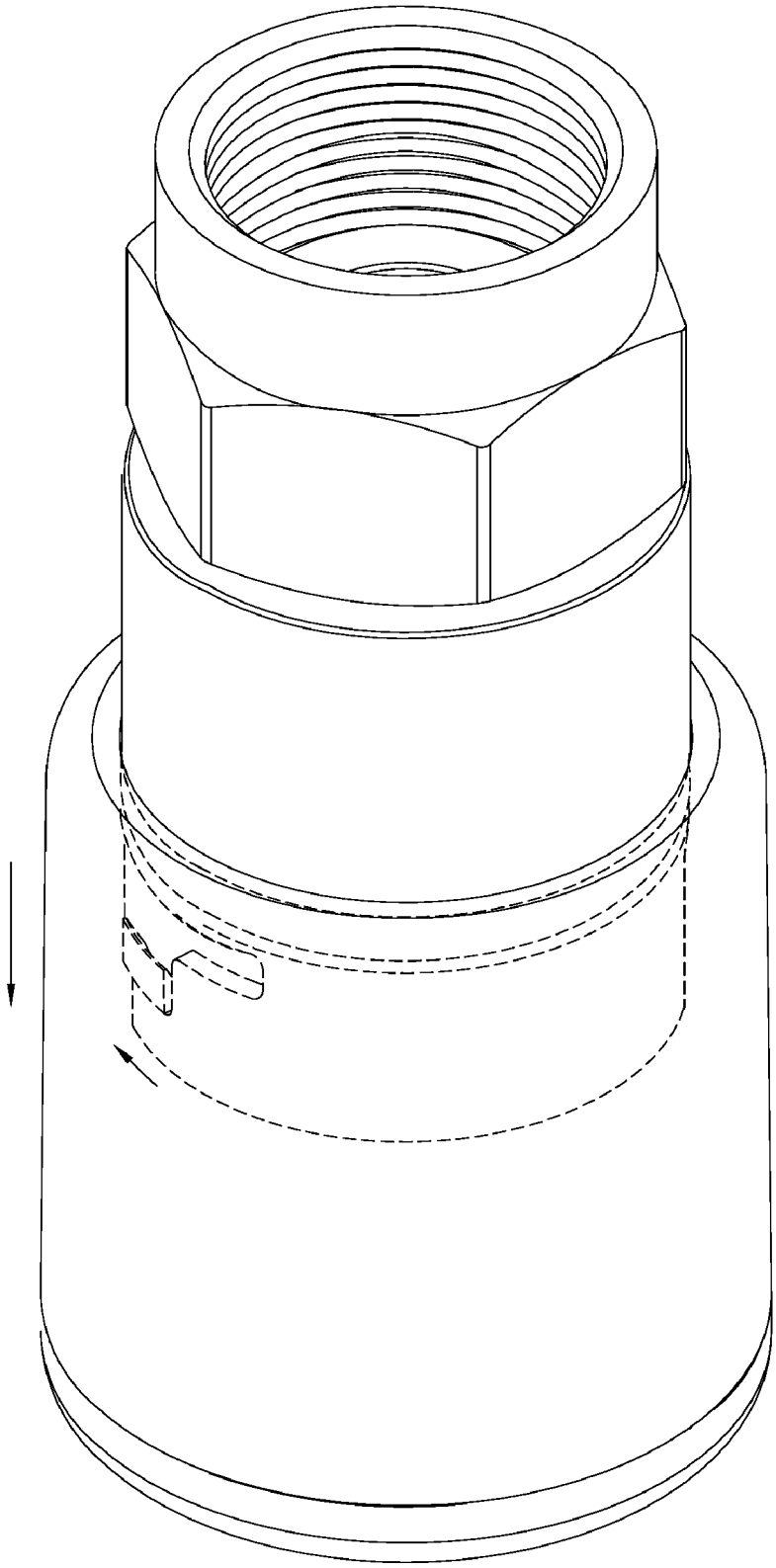
FIG. 7 is a perspective view showing the operation of the joint for the cable according to the preferred embodiment of the present invention.

Referring to FIGS. 1-7, a joint for a cable in accordance with a preferred embodiment of the present invention includes a connecting sleeve 10, an internal tube 20, an inner fitting member 30, an outer fitting member 40, a sheath member 50, and a banding member 60, wherein the inner fitting member 30, the outer fitting member 40, and the sheath member 50 are made of plastic material.

The connecting sleeve 10 is formed in an annular tube shape, and includes threads 11 formed around an inner wall of a first opening of an upper end thereof to be screwed to an entry of an electronic device, and includes a shoulder 12 extending around a bottom end of an inner wall thereof, and includes a locking section 13 mounted on an outer wall thereof and formed in a hexagon shape to correspond to an allen wrench.

The internal tube 20 is fitted to the connecting sleeve 10 and formed in a hollowly elongated tube shape to insert into a core segment of the cable, and includes an arresting ring 21 extending outward around an upper end thereof to abut against the shoulder 12 of the connecting sleeve 10 so as to prevent the connecting sleeve 10 from sliding out of the internal tube 20, and includes a circular groove 22 arranged around an outer wall thereof.

The inner fitting member 30 is a hollow housing, and includes an orifice formed on a bottom end of a fourth opening thereof, and includes a hole 31 disposed on a top surface thereof, the hole 31 includes a circular projection 311 formed around an inner surface thereof to correspond to the circular groove 22 of the internal tube 20 such that the inner fitting member 30 is fitted to the outer wall of the internal tube 20 by using the hole 31 and further enable to rotate the connecting sleeve 10. The inner fitting member 30 also includes at least one curved recess 32 formed on an outer wall of a lower side thereof, and the recess 32 becomes concaved upward from the bottom end of the inner fitting member 30 and after bending toward one side of the inner fitting member 30 and extending upward. The inner fitting member 30 further includes an annular slot 33 formed on a middle section of an external surface thereof, and the annular slot 33 includes a washer 34 fitted thereon. The inner fitting member 30 further includes an insertion 35 extending from the bottom end thereof.

The outer fitting member 40 is a hollow housing and includes two ends, each having a second opening, to be fitted to the inner fitting member 30, the outer fitting member 40 also includes a protrusion 41 extending proximate to an inner rim of the second opening of a top end thereof to correspond to the recess 32 of the inner fitting member 30 so that the protrusion 41 is fixed in the recess 32 to slide, and includes a first fixing section 42 disposed on a bottom end thereof, the first fixing section 42 includes at least one retaining trench.

The sheath member 50 is flexible and formed in a tube shape, and includes two ends, each with a third opening, includes a bore 51 mounted on an upper end thereof. When the bore 51 is not forced, its outer diameter is slightly smaller than the insertion 35 of the inner fitting member 30, and the bore 51 includes an annular cutout 52 formed on an outer wall thereof and a raised loop 53 fixed on a bottom end thereof, an outer diameter of the raised loop 53 correspond to an inner wall of the outer fitting member 40, and the raised loop 53 includes a second fixing section 54 secured on an outer wall thereof to correspond to the first fixing section 42 of the outer fitting member 40. In this embodiment, the second fixing section 54 is an engaging block to correspond to the retaining trench and is retained in the retaining trench of the outer fitting member 40. The banding member 60 is a metal coil and fitted to the annular cutout 52 of the sheath member 50.

In operation, the bore 51 of the sheath member 50 is expanded to be fitted to the insertion 35 of the inner fitting member 30, and then the protrusion 41 of the outer fitting member 40 is placed in a fourth opening of a lower side of the recess 32 of the inner fitting member 30 and slid to a top portion of the recess 32, then the prepared cable is inserted from the third opening of a bottom end of the sheath member 50 and pushed further so that the core segment of the cable is inserted through the internal tube 20, and a jacket of the cable is fitted to the outer wall of internal tube 20. Thereafter, the protrusion 41 of the outer fitting member 40 is slid downward from the recess 32 of the inner fitting member 30 and further slid into a bottom end of the recess 32 by using a relative rotation between the inner fitting member 30 and the outer fitting member 40. In the meantime, the sheath member 50 is actuated by the outer fitting member 40 to slide downward, and the bore 51 is directly banded to the jacket of the cable to be fixed by the banding member 60 securely.

While we have shown and described various embodiments in accordance with the present invention, it is clear to those skilled in the art that further embodiments may be made without departing from the scope of the present invention.

What is claimed:

1. A joint for a cable comprising:

a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape to insert into a core segment of the cable, and including an arresting ring extending outward around an upper end thereof to abut against the shoulder of the connecting sleeve, and including a circular groove arranged around an outer wall thereof;

an inner fitting member being a hollow housing, and including an orifice formed on a bottom end of a fourth opening thereof, and including a hole disposed on a top surface thereof, the hole including a circular projection formed around an inner surface thereof to correspond to the circular groove of the internal tube such that the inner fitting member is fitted to the outer wall of the internal tube by using the hole and further enable to rotate the connecting sleeve, the inner fitting member also including at least one curved recess formed on an outer wall of a lower side thereof, and the recess becoming concaved upward from the bottom end of the inner fitting member and after bending toward one side of the inner fitting member and extending upward, and the inner fitting member further including an insertion extending from the bottom end thereof;

an outer fitting member being a hollow housing and including two ends, each having a second opening, to be fitted to the inner fitting member, the outer fitting member also including a protrusion extending proximate to an inner rim of the second opening of a top end thereof to correspond to the recess of the inner fitting member, and including a first fixing section disposed on a bottom end thereof;

a sheath member being flexible and formed in a tube shape, and including two ends, each having a third opening, and including a bore mounted on an upper end thereof, when the bore is not forced, its outer diameter being slightly smaller than the insertion of the inner fitting member, and the bore including an annular cutout formed on an outer wall thereof and a raised loop fixed on a bottom end thereof, an outer diameter of the raised loop being in response to an inner wall of the outer fitting member, and the raised loop including a second fixing section secured on an outer wall thereof to correspond to the first fixing section of the outer fitting member;

a banding member fitted to the annular cutout of the sheath member.

2. The joint for the cable as claimed in claim 1, wherein the first fixing section of the outer fitting member is at least one retaining trench.

3. The joint for the cable as claimed in claim 1, wherein the inner fitting member, the outer fitting member, and the sheath member are made of plastic material.

4. The joint for the cable as claimed in claim 2, wherein the inner fitting member, the outer fitting member, and the sheath member are made of plastic material.

5. The joint for the cable as claimed in claim 3, wherein the banding member is a metal coil.

6. The joint for the cable as claimed in claim 4, wherein the banding member is a metal coil.

7. The joint for the cable as claimed in claim 5, wherein the connecting sleeve includes a locking section mounted on an outer wall thereof and formed in a hexagon shape to correspond to an allen wrench.

8. The joint for the cable as claimed in claim 6, wherein the connecting sleeve includes a locking section mounted on an outer wall thereof and formed in a hexagon shape to correspond to an allen wrench.

9. The joint for the cable as claimed in claim 7, wherein the inner fitting member includes an annular slot formed on a middle section of an external surface thereof, and the annular slot includes a washer fitted thereon.

10. The joint for the cable as claimed in claim 8, wherein the inner fitting member includes an annular slot formed on a middle section of an external surface thereof, and the annular slot includes a washer fitted thereon.

* * * * *